US007874455B2

(12) United States Patent
Jordan et al.

(10) Patent No.: US 7,874,455 B2
(45) Date of Patent: Jan. 25, 2011

(54) DISPENSER AND GLOVES

(75) Inventors: Earl Jordan, Aliso Viejo, CA (US); Paul R. Persiani, Rancho Santa Margarita, CA (US); Mark Robinson, Torrance, CA (US)

(73) Assignee: OneGlove, LLC, Laguna Woods, CA (US)

( * ) Notice: Subject to any disclaimer, the term of this patent is extended or adjusted under 35 U.S.C. 154(b) by 281 days.

(21) Appl. No.: 11/302,625

(22) Filed: Dec. 13, 2005

(65) Prior Publication Data

US 2007/0131706 A1 Jun. 14, 2007

(51) Int. Cl.
*B65H 3/60* (2006.01)
*B65H 3/00* (2006.01)
*B65H 1/00* (2006.01)

(52) U.S. Cl. ..... 221/197; 221/40; 221/49; 221/196; 221/63; 221/58

(58) Field of Classification Search ..... 221/197, 221/48, 49, 52, 198, 46, 58, 63, 40
See application file for complete search history.

(56) References Cited

U.S. PATENT DOCUMENTS 3,089,597 A * 5/1963 Kaplan ..... 224/400
3,266,666 A 8/1966 Nelson
3,369,698 A 2/1968 Scholz
3,696,980 A * 10/1972 Waltz ..... 225/66
4,138,034 A 2/1979 McCarthy
4,185,754 A 1/1980 Julius
4,535,912 A * 8/1985 Bonk ..... 221/46
4,638,921 A 1/1987 Sigl et al.
4,863,084 A 9/1989 Nabozny
4,865,221 A 9/1989 Jackson et al.
4,896,773 A 1/1990 Zilio
4,942,992 A * 7/1990 Fischer et al. ..... 224/240
4,951,815 A 8/1990 Ulbrich
4,993,589 A 2/1991 McLaughlin
4,997,105 A 3/1991 Fischer
5,044,493 A 9/1991 Crawford et al.

(Continued)

FOREIGN PATENT DOCUMENTS

EP 1 136 412 A1 9/2001

(Continued)

OTHER PUBLICATIONS

PCT International Search Report dated Sep. 13, 2007 and mailed Oct. 26, 2007 from corresponding PCT Application No. PCT/US06/47536 filed Dec. 13, 2006 (3 pages).

(Continued)

*Primary Examiner*—Stefanos Karmis
*Assistant Examiner*—Michael Butler
(74) *Attorney, Agent, or Firm*—Klein O'Neill & Singh, LLP

(57) ABSTRACT

Gloves and dispensers for gloves are generally discussed herein with particular discussions extended to disposable gloves packaged in a disposable dispenser configured to engage with a carrier. Aspects of the glove assemblies provided herein include a dispenser case having a flange having locking tab for sliding engagement with a channel on the carrier. The dispenser case may be removed from the carrier and a new dispenser case engaged to the carrier.

11 Claims, 7 Drawing Sheets

U.S. PATENT DOCUMENTS

| | | | | | |
|---|---|---|---|---|---|
| 5,044,494 | A | | 9/1991 | Tamurah | |
| 5,088,620 | A | | 2/1992 | Kelliher et al. | |
| 5,096,089 | A | | 3/1992 | McLaughlin | |
| 5,175,977 | A | | 1/1993 | Crawford et al. | |
| 5,190,197 | A | * | 3/1993 | Novak | 224/312 |
| 5,264,785 | A | * | 11/1993 | Greason | 323/350 |
| 5,265,785 | A | * | 11/1993 | Chudy | 224/666 |
| 5,323,994 | A | | 6/1994 | Shillington et al. | |
| 5,392,974 | A | | 2/1995 | Johnson-Rabbett | |
| 5,456,354 | A | * | 10/1995 | Wood | 206/278 |
| 5,542,566 | A | | 8/1996 | Glaug et al. | |
| 5,740,943 | A | | 4/1998 | Shields et al. | |
| 5,816,440 | A | | 10/1998 | Shields et al. | |
| 5,884,804 | A | | 3/1999 | King | |
| 5,896,983 | A | | 4/1999 | Wood | |
| 5,921,434 | A | * | 7/1999 | Hollander et al. | 221/34 |
| 5,938,069 | A | | 8/1999 | Macchia | |
| 6,021,919 | A | | 2/2000 | Kelly | |
| 6,250,495 | B1 | | 6/2001 | Bando | |
| 6,431,360 | B1 | | 8/2002 | Julius | |
| 6,543,642 | B1 | * | 4/2003 | Milliorn | 221/46 |
| 6,550,635 | B1 | * | 4/2003 | King et al. | 221/49 |
| 6,578,731 | B1 | | 6/2003 | Lewis et al. | |
| 6,585,130 | B2 | * | 7/2003 | Turbett et al. | 221/45 |
| 6,644,501 | B2 | | 11/2003 | Iida | |
| 6,708,841 | B2 | | 3/2004 | Baughman | |
| 6,820,753 | B2 | * | 11/2004 | Kurtz et al. | 211/53 |
| 2003/0230591 | A1 | * | 12/2003 | Jordan et al. | 221/38 |
| 2007/0094766 | A1 | * | 5/2007 | Liu | 2/159 |

FOREIGN PATENT DOCUMENTS

| | | |
|---|---|---|
| WO | WO 00/41641 | 7/2000 |

OTHER PUBLICATIONS

Written Opinion of the International Searching Authority dated Sep. 13, 2007 and mailed Oct. 26, 2007 from corresponding PCT Application No. PCT/US06/47536 filed Dec. 13, 2006 (6 pages).

PCT International Search Report mailed Feb. 17, 2004 from corresponding PCT Application No. PCT/US02/32142 filed Oct. 8, 2002 (8 pages).

PCT International Preliminary Examination Report mailed Aug. 11, 2005 from corresponding PCT Application No. PCT/US02/32142 filed Oct. 8, 2002 (6 pages).

Notice of Allowance mailed Feb. 16, 2006 from related U.S. Appl. No. 10/172,192.

Final Office Action mailed Nov. 21, 2005 from related U.S. Appl. No. 10/172,192.

Office Action mailed May 31, 2005 from related U.S. Appl. No. 10/172,192.

Advisory Action mailed Nov. 9, 2004 from related U.S. Appl. No. 10/172,192.

Final Office Action mailed Aug. 19, 2004 from related U.S. Appl. No. 10/172,192.

Office Action mailed May 6, 2004 from related U.S. Appl. No. 10/172,192.

Office Action mailed Mar. 10, 2004 from related U.S. Appl. No. 10/172,192.

Examiner's Answer mailed Mar. 18, 2009 from related U.S. Appl. No. 11/372,312.

Advisory Action mailed Apr. 18, 2008 from related U.S. Appl. No. 11/372,312.

Final Office Action mailed Dec. 28, 2007 from related U.S. Appl. No. 11/372,312.

Office Action mailed Jul. 6, 2007 from related U.S. Appl. No. 11/372,312.

Notice of Allowance mailed Feb. 11, 2005 from related U.S. Appl. No. 10/803,447.

Office Action mailed Sep. 1. 2004 from related U.S. Appl. No. 10/803,447.

Office Action mailed Mar. 31, 2010 from corresponding U.S, Appl. No. 11/863,750.

Final Office Action mailed Oct. 16, 2009 from corresponding U.S. Appl. No. 11/863,750.

Office Action mailed Dec. 23, 2008 from corresponding U.S. Appl. No. 11/863,750.

Office Action mailed May 14, 2009 from related European Application No. 02 769 011.4-2314.

Office Action mailed Nov. 29, 2007 from related European Application No. 02 769 011.4-2314.

Supplemental European Search Report mailed Aug. 17, 2008 from related European Application No. 02 769 011.4-2314.

Extended European Search Report mailed Jun. 10, 2010 from related European Application No. 10153561.5-2314 (9 pages).

* cited by examiner

DISPENSER AND GLOVES

CROSS-REFERENCE TO RELATED APPLICATIONS

This application may be related to U.S. Pat. No. 6,901,723, which is a divisional of Ser. No. 10/172,192, filed on Jun. 12, 2002, the contents of which are expressly incorporated herein by reference.

BACKGROUND

An unremitting upsurge in disposable glove use continues for over two decades. The initial surge occurred in 1985, when The Centers for Disease Control and Prevention (CDC) developed the strategy of "universal blood and body fluid precautions," which are based on the premise that all patients should be assumed to be infectious for HIV and other blood-borne pathogens. These strategies were formalized in "CDC Guidelines for Prevention of Transmission of Human Immunodeficiency Virus and Hepatitis B Virus to Health-Care and Public-Safety Workers," MMWR 1989; 38(S-6): 1-36. In general, "universal precautions" requiring disposable glove use should be followed when workers are exposed to blood, certain other body fluids (amniotic fluid, pericardial fluid, peritoneal fluid, pleural fluid, synovial fluid, cerebrospinal fluid, semen, and vaginal secretions), or any body fluid visibly contaminated with blood. In recent years, many antibiotic-resistant, virulent, and lethal microorganisms have become increasingly widespread, including human immunodeficiency virus (HIV), hepatitis B, necrotizing staphylococcus, Vancomycin-resistant enterococcus and multi-drug-resistant tuberculosis. The use of gloves as a barrier to prevent transmission of microorganisms between patients and health care professionals has become a predominant issue in today's clinical settings, including physicians' and dentists' offices.

Disposable glove use is burgeoning beyond the clinical setting, as well. Emergency, law enforcement, correctional facility, and public-safety workers often encounter unpredictable and emergent exposures, which may make the identification of hazardous body fluids very difficult and often impossible. Furthermore, not only must workers be protected from exposure to blood and other potentially infectious body fluids in the course of their work activities, they also must protect others from infection through cross-contamination. For example, childcare and preschool centers, and even kindergartens, have become transmission points for antibiotic-resistant blood-borne pathogens.

Many workers in diverse occupations such as, in the electronics, medical device, pharmaceutical, agricultural, nuclear, industrial chemical and pesticide handling, waste management, painting, cosmetic, and body art industries and services increasingly look to a ready supply of disposable gloves to reduce their exposure to, and skin contact with, potentially hazardous materials. These materials can include toxic chemicals, pesticides, cytotoxic drugs, radioactive materials, and human, animal, or biological tissues, fluids, and wastes. Moreover, increased public concerns regarding the transmission of disease have led to measures to protect food during preparation and service.

Thus, disposable gloves have become the most ubiquitous form of barrier-type personal protective equipment, creating a $1.2 billion latex and synthetic glove market in 2003, in which nearly 32 billion gloves were sold in the U.S.A. alone. In many settings, disposable gloves are either legally mandated or considered to be integral with the principles of good practice.

Disposable gloves should fit properly, and should not be washed or reused. Also, gloves should be replaced once soiled or damaged, and in-between patients, victims, products, and work areas. It is desirable that even non-sterile disposable gloves be kept as clean as possible prior to use. Otherwise, biological and physical contaminants may be inadvertently transferred to the patient, the product, or the work area by the soiled gloves. Accordingly, it is most desirable to minimize contact with the finger portions of clean gloves.

Typically, disposable gloves are dispensed in random orientations from large containers or open plastic bins located at stationary points, which are subject to gross manipulation. These containers usually hold 100 or more gloves, are fixed to a sink, wall, or bulkhead, and may be covered by a metal, plastic, or wooden cover, primarily for cosmetic purposes. Often, these covers themselves can become reservoirs for pathogens. Also, these dispensers can be at some distance from the patients or work areas. If a worker exhausts their immediate supply of gloves, another trip to the dispenser site is required. As a result, glove users are often compelled to haphazardly cram extra gloves into pockets, pouches, and sacks, a practice which can grossly soil clean gloves, can intermingle clean objects with contaminated objects, and can lead to gloves falling out of pockets at inopportune moments.

Existing portable disposable glove holders do allow glove users to carry a ready supply of gloves. However, these portable disposable glove holders are reusable and refillable. With each subsequent reuse comes an additional risk of cross-contamination of the container, and thus the gloves, with accumulated microbes, chemical agents, dust, soil, blood, and any other particulate foreign material. Furthermore, such portable dispensers are refilled by manually cramming a quantity of randomly-oriented gloves, which first were plucked from a dispenser, such that gloves are handled by contact with whatever glove surface may be present at the dispenser opening, including the fingers.

For example, in U.S. Pat. No. 5,392,974, issued to Johnson-Rabbett on Feb. 28, 1995, and entitled "Medical glove holder," a glove holder is disclosed that is adapted to be carried by the belt of the user, particularly, emergency medical personnel, and that is adapted for use with a substantial supply of protective gloves. Also, a dispensing opening, intended to dispense one glove at a time, is provided. This glove holder, however, is a reusable pouch made from flexible sheet material sewn together to form gusset-fold sides and a closure flap on top. The dispensing opening is a restrictive slit in front side of the sheet material that constrains the movement of gloves "stuffed" in random orientation therein. The reuse of the pouch and manipulation of the gloves during loading and unloading can encourage gross contamination of the dispenser and otherwise clean gloves. Furthermore, even if treated, fabric can attract and harbor pathogens.

As another example, in U.S. Pat. No. 5,265,785, issued to Chudy on Nov. 30, 1993, and entitled "Protective glove provider," a portable canister includes removably, lockably, interconnected body and base members which are comprised of semi-rigid materials, and are configured to provide a rigid canister when the members are joined. The body, which can be cylindrical, has an end wall of reduced thickness, relative to the rest of the body. In the thinner end wall is an aperture defined by flexible spokes through which gloves can be inserted and removed. The base member is provided to provide structural rigidity to the body member, and to attach thereto means for attaching the canister to a glove user or a convenient object.

As before, the glove holder is reusable, and replacement gloves are randomly stuffed into the canister, potentially leading to gross contamination of the gloves and accumulation of particulate foreign material on the canister. In addition, the canister is generally cylindrical, and can intrude against the waist of the user. This may lead to discomfort in situations where glove users are required to crouch and bend while rendering assistance or performing their duties.

SUMMARY

The present invention may be implemented by providing a glove assembly, comprising a carrier comprising carrier body defining a receiving space having a channel and an attachment device connected to the carrier body for attaching the carrier to an article; a dispenser case comprising a plurality of walls defining a receiving space adapted to contain a bundle of gloves, the dispenser case comprising an opening for dispensing the gloves received within the receiving space, wherein the dispenser case is positioned in the receiving space and partially overlaps the channel.

The present invention may also be practiced by providing a dispenser case adapted to store a bundle of gloves and engage a carrier for use as a glove assembly, the dispenser case comprising a dispenser container comprising a plurality of side walls comprising a flange and a top wall comprising an opening, a base wall comprising a flange attached to the flange on the dispenser container along a common peripheral edge, a locking protrusion extending radially away from the attached two flanges, and wherein the plurality of side walls extend away from a plane defined by the attached two flanges.

In yet another aspect of the present invention, there is provided a dispenser case adapted to store a bundle of gloves and engage a carrier for use as a glove assembly, the dispenser case comprising a thermoplastic dispenser container comprising a plurality of side walls and a top wall comprising a dispensing opening and a base wall attached to the dispenser container; a groove comprising two groove walls and a groove bottom defining a race extending along at least a portion of the base wall, wherein a plurality of gloves are disposed between the plurality of side walls.

In yet other aspects of the present invention, there is provided provisions for removably disposing a dispenser case from a carrier and then installing a replacement dispenser case to the carrier.

In still yet other aspects of the present invention, a dispenser case incorporates a flange and a carrier incorporates two receiving channels for receiving the flange. The flange and the two channels mate with detent engagements for securely mounting the dispensing case to the carrier.

In yet another aspect of the present invention, a pivotable attachment device is pivotally connected to a carrier body for selectively engaging the carrier to an article, such as a belt or a coat.

Other aspects and variations of the glove assemblies summarized above are also contemplated and will be more fully understood when considered with respect to the following disclosure.

BRIEF DESCRIPTION OF THE DRAWINGS

These and other features and advantages of the present invention will become appreciated as the same become better understood with reference to the specification, claims and appended drawings wherein:

DETAILED DESCRIPTION

The detailed description set forth below in connection with the appended drawings is intended as a description of the presently preferred embodiments of disposable gloves, glove dispensers, and glove carriers (hereinafter collectively referred to as "glove assembly or assemblies") provided in accordance with aspects of the present invention and is not intended to represent the only forms in which the present invention may be constructed or utilized. The description sets forth the features and the steps for constructing and using the glove assemblies of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like or similar elements or features.

FIGS. 1-4 illustrate an embodiment of a glove dispenser case 100 provided in accordance with aspects of the present invention. In one exemplary embodiment, the dispenser case 100 is configured to enclose a plurality of gloves folded by the methods disclosed in U.S. Pat. No. 6,901,723. However, any folding technique may be used to fold the plurality of gloves into a stack of gloves aside from the superjacent opposing fold methods disclosed in the '723 patent, such as for example, folding the gloves in halves and stacking them on top of one another or folding them in fourths and stacking them on top of one another, either with or without interleaving them. When the methods described in the '723 patent are employed, the cuff section of a glove automatically projects out through the opening of the dispenser as the preceding glove is dispensed, as described in the '723 patent.

The dispenser case 100 provided in accordance with aspects of the present invention may be made from a transparent or opaque plastic or other rigid or semi-rigid materials. The dispenser case 100 can have a rectangular, a cylindrical or any other appropriately shaped container configuration for storing gloves or bundles of gloves with the rectangular configuration being more preferred. The dispenser case 100 can be made from any suitable natural, synthetic, composite, and laminate materials, including, without limitation, paper and board materials; metals and foils; rubber products; and plastics such as polypropylene; polyvinylchloride; polycarbonate; polyethylene, including PET, HDPE, and LDPE; polytetrafloralethylene; and combinations thereof. In a preferred embodiment, the dispenser case 100 is made from a polyvinylchloride material.

Figure 1:
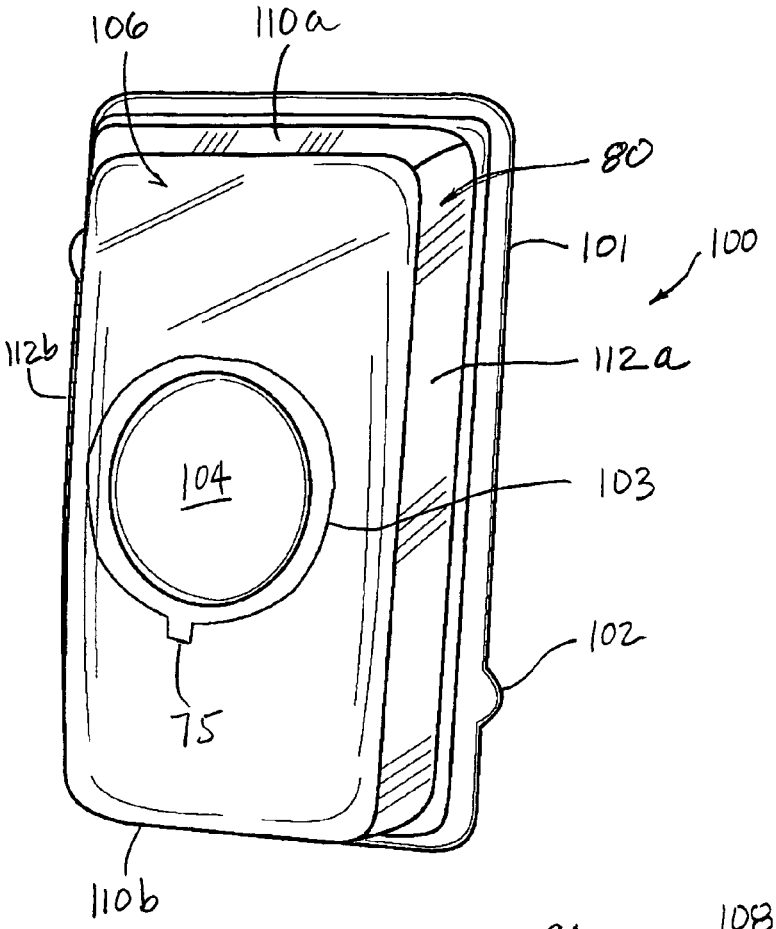
FIG. 1 is an exemplary semi-schematic perspective view of a dispenser case provided in accordance with aspects of the present invention.

FIG. 1 is a perspective view of an embodiment of the dispenser case 100 provided in accordance with aspects of the present invention. The dispenser case 100 can include a base or base wall 108 (best seen in FIGS. 2 and 2A), a top wall 106, two short side walls 110*a*, 110*b*, two long side walls 112*a*, 112*b*, and a dispensing opening 104 disposed on the top wall 106. The dispenser case 100 may be formed from a rectangular box-like container in which the top 106 joins the two long side walls 112*a*, 112*b* and the two short side walls 110*a* , 110*b*. Each short wall 110*a/b* abuts two adjacent long walls 112*a*, 112*b*. The top wall 106, the short side walls 110*a*, 110*b*, and the long side walls 112*a*, 112*b*, which are collectively herein sometimes referred to as a dispenser container 80, define a container cavity for receiving a plurality of folded gloves, as further discussed below. The base 108 may be sealed to the dispenser container 80 along a common peripheral edge after the folded gloves are placed therein to seal the packaged gloves inside the container. In one exemplary embodiment, the dispenser container 80 is made from a vacuum formed process and the side walls 110*a*, 110*b*, 112*a*, 112*b* and top wall 106 are integrally formed from a single sheet of polyvinylchloride material comprising an opening 104.

In one exemplary embodiment, the dispensing opening 104, which is shown with a circular configuration, is located at the center of the top wall 106. However, it may be formed on any appropriate side or portion of the dispenser case 100. Although the dispensing opening 104 is shown with a circular opening, an elliptical, curvilinear, rectilinear, or other appropriate shape may be incorporated without deviating from the spirit and scope of the present invention. A glove can be removed from the dispenser case 100 by a user through the dispensing opening 104. In one exemplary embodiment, a removable adhesive cover 103 with an optional pull tab 75 (FIG. 1) is applied over the dispensing opening 104 to seal the gloves or the contents within the dispenser case 100 from contaminants. When a user wants to remove a glove, he or she can remove the cover 103 simply by peeling the adhesive cover all the way off or partially off to access the glove. The adhesive cover 103 can be placed back over the opening 104, if peeled completely off, to prevent contaminating the remaining gloves or alternatively disposed of to leave the opening 104 exposed. Any prior art plastic, foam, foil, or other material with adhesive backing may be used to make the adhesive cover 103 with plastic being more preferred.

In one exemplary embodiment, the dispenser container 80 and the base 108 each has a peripheral flange 82 that generally overlaps one another. The two flanges 82 have a common extended edge 101 that extends radially outwardly from the short and long side walls 110*a*, 110*b*, 112*a*, 112*b* in a coplanar manner from the base 108. After filling the cavity of the dispenser container 80 with a stack of gloves, the base 108 is placed over the opening of the container 80 and the two flanges 82 bonded to one another to form a sealed dispenser case 100. In a preferred embodiment, the two flanges 82 are ultrasonically welded together, using for example, e.g., a high frequency weld, to more permanently seal the bundle of gloves placed inside the container cavity.

In one exemplary embodiment, two locking protrusions 102, each having a semicircular shaped tab, project from the extended edge 101. The two locking protrusions may be formed by providing a semicircular extension on the flange 82 of both the base 108 and the dispenser container 80 and then bonding the two. One locking protrusion 102 can be located proximate a corner of the base 108 along one long side wall 112*a*. A second locking protrusion 102 can be located proximate the opposite corner of the base 108 along the other long side wall 112*b*. In other embodiments, a plurality of locking protrusions 102 can be located anywhere along the extended edge 101 and can have a triangular, rectangular, or any other appropriate shape with semicircular being more preferred.

Figure 2A:
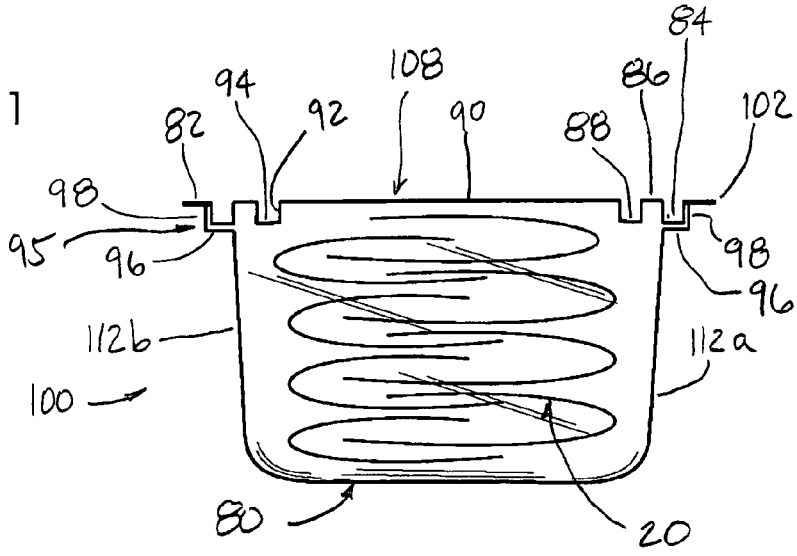
FIG. 2A is a cross-sectional side view of the dispenser case of FIG. 2 taken along line 2A-2A.
Figure 2:
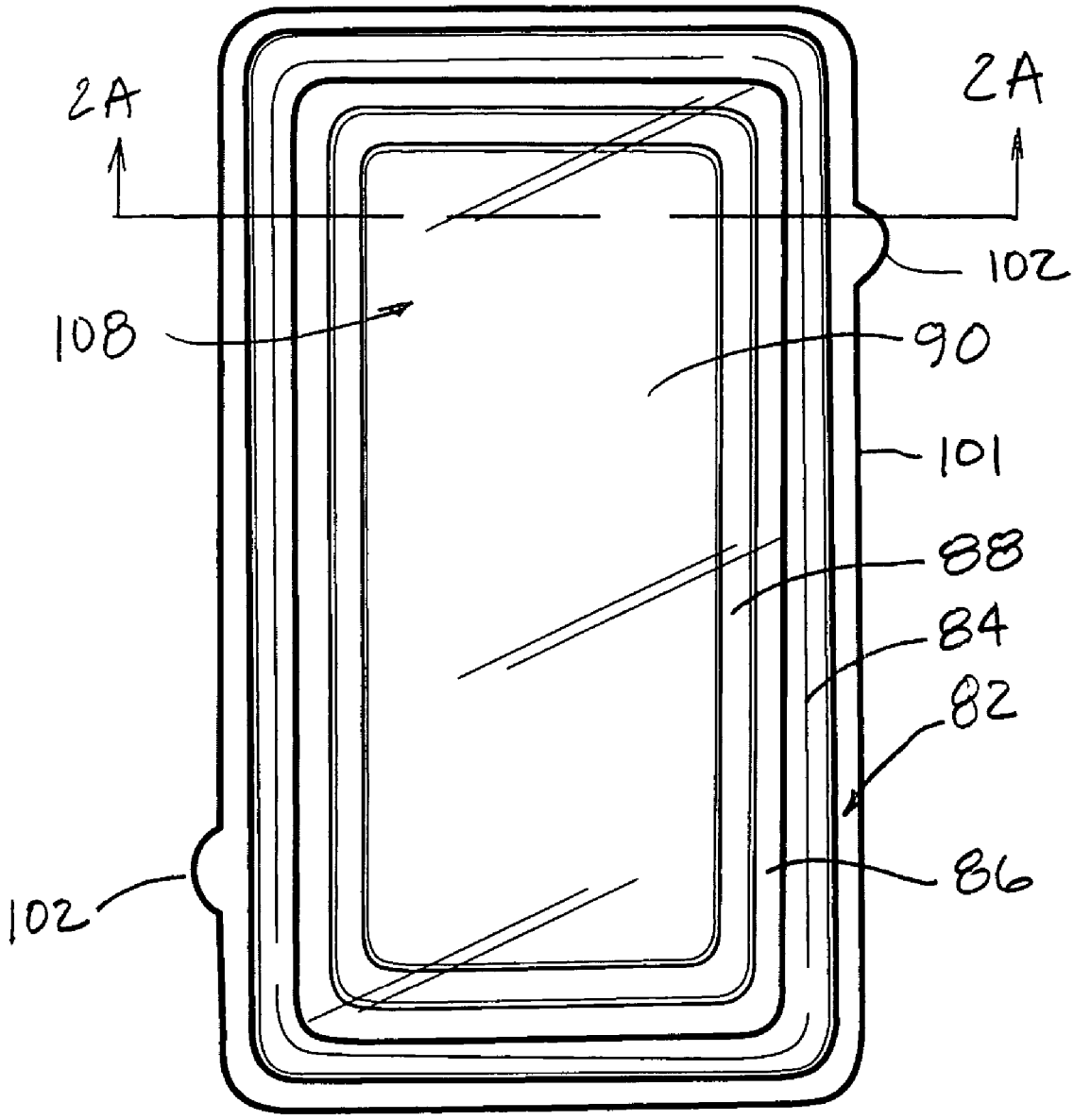
FIG. 2 is an exemplary semi-schematic rear view of the embodiment of FIG. 1 of a dispenser case.

FIG. 2 is a rear view of the base 108 and FIG. 2A is a cross-sectional side view of the dispenser container 100 of FIG. 2 taken along line 2A-2A. In one exemplary embodiment, the common flange 82 comprises a first groove 84, a retaining wall 86, a second groove 88, and a base bottom 90. The first and second grooves 84, 88, which are spaced apart from one another by the retaining wall 86, may be incorporated to provide added structural rigidity to the base 108. Each groove comprises two groove walls 92 and a groove bottom 94 defining a race (FIG. 2A). As shown in FIG. 2, the two grooves 84, 88 expand a complete loop along or near the perimeter of the base 108 to provide uniform rigidity along the entire periphery of the base 108. Alternatively, zero or one groove or more than two grooves may be incorporated without deviating from the spirit and scope of the present invention. Still alternatively, the grooves 84, 88 may extend only partially along the periphery of the base 108 or extend down the center of the base.

In one exemplary embodiment, the dispenser container 80 incorporates a lip 95 having a first short wall 96 and a second short wall 98 at an angle to one another (FIG. 2A). The lip 95 is sized to receive the base 108, and more particularly the outer groove 84 in a socket-like arrangement. The socket-like arrangement allows the base 108 to snap-fit with the dispenser container 80 until the two are more permanently secured at the overlapping flanges 82, using ultrasonic welding, adhesive, heat die, and the like. Also shown in FIG. 2A is a bundle of gloves 20, which may be folded and stacked using any appropriate fold and stack technique inside the dispenser case 80 with the methods disclosed in the '723 patent being most preferred, as previously discussed.

Figure 3:
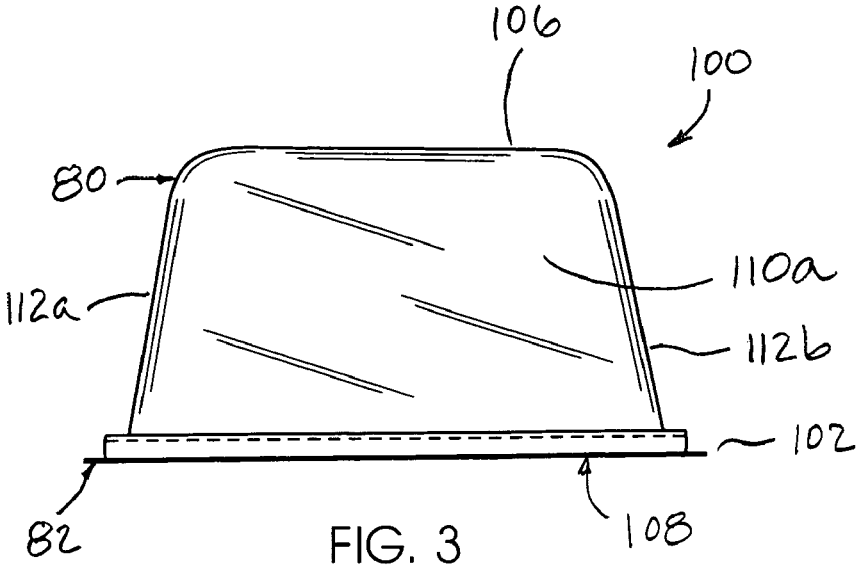
FIG. 3 is an illustration of an end view of the embodiment of FIG. 1 of a dispenser case.
Figure 4:
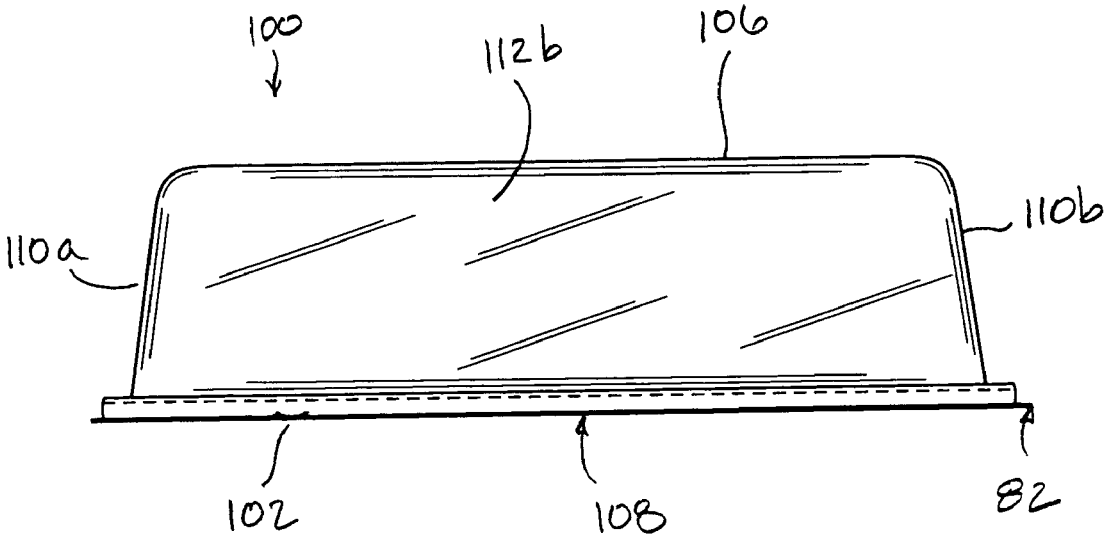
FIG. 4 is an illustration of a side view of the embodiment of FIG. 1 of a dispenser case.

FIG. 3 shows an end view of the embodiment of FIG. 1 of a dispenser case 100 according to aspects of the present invention. FIG. 4 shows a side view of the embodiment of FIG. 1 of a dispenser case 100 according to aspects of the present invention. Although the dispenser case 100 is symmetrical, as shown in FIGS. 2, 2A, 3, and 4 about various axes that may be drawn through the dispenser case 100, the dispenser case can be non-symmetrical or off-set without deviating from the spirit and scope of the present invention.

FIGS. 5-9 illustrate an embodiment of a glove carrier 200 for carrying or engaging the dispenser case 100 according to aspects of the present invention. In one exemplary embodiment, the carrier 200 is made from a rigid or semi-rigid thermoplastic material, with rigid being more preferred. Exemplary thermoplastic materials include suitable natural, synthetic, composite, and laminate materials, including, without limitation, polypropylene; polyvinylchloride; polycarbonate; polyethylene, including PET, HDPE, and LDPE; polytetrafloralethylene; and combinations thereof. Alternatively, the carrier 200 may be made from paper and board materials; from a metal material (such as aluminum or stainless steel), from foils; from rubber products, or from combinations thereof with plastic being most preferred.

Figure 5:
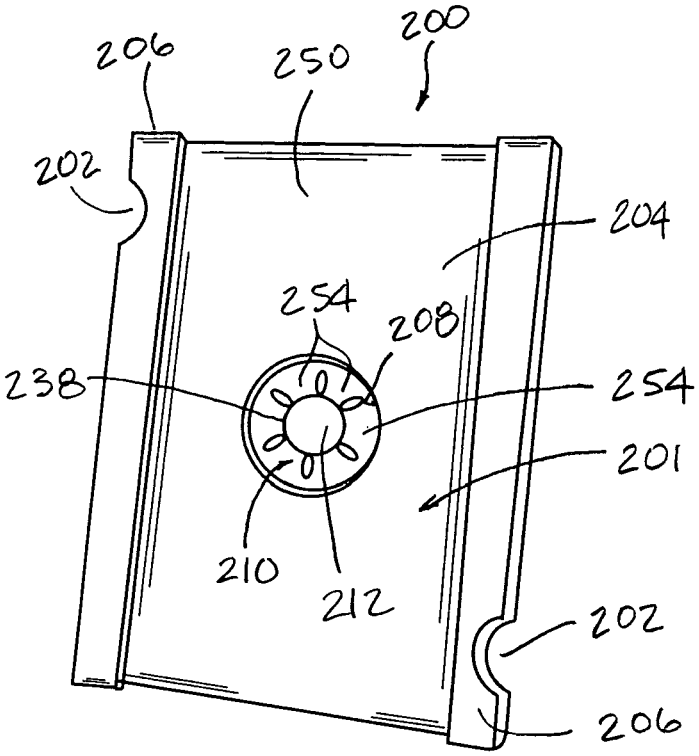
FIG. 5 is an exemplary semi-schematic perspective view of a carrier provided in accordance with aspects of the present invention.
Figure 7:
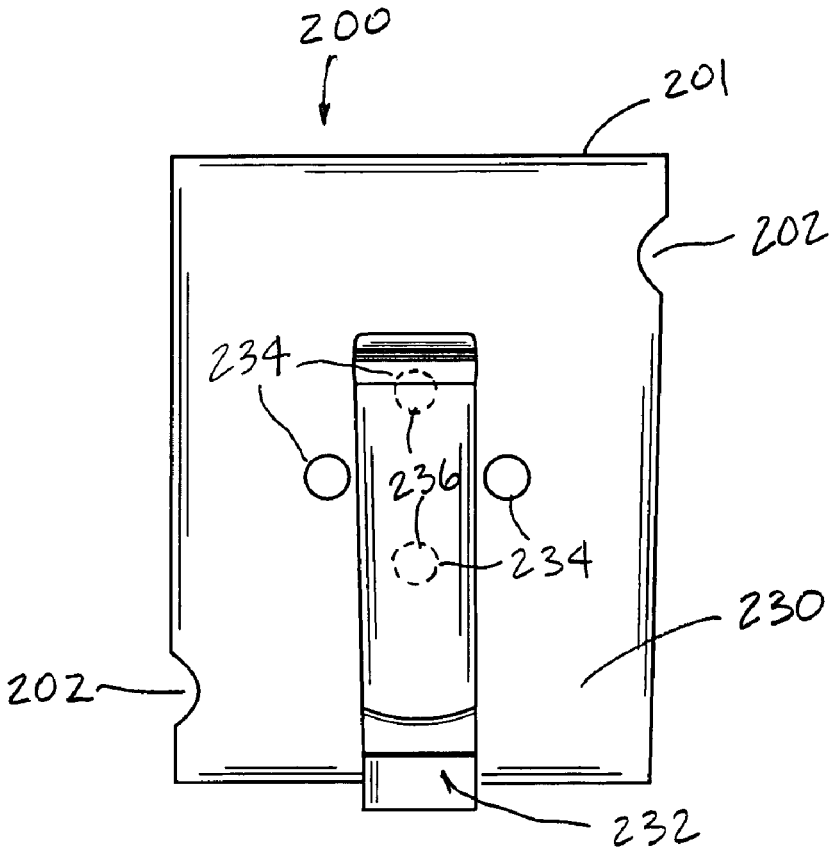
FIG. 7 is an illustration of a rear view of the embodiment of FIG. 5.
Figure 8:
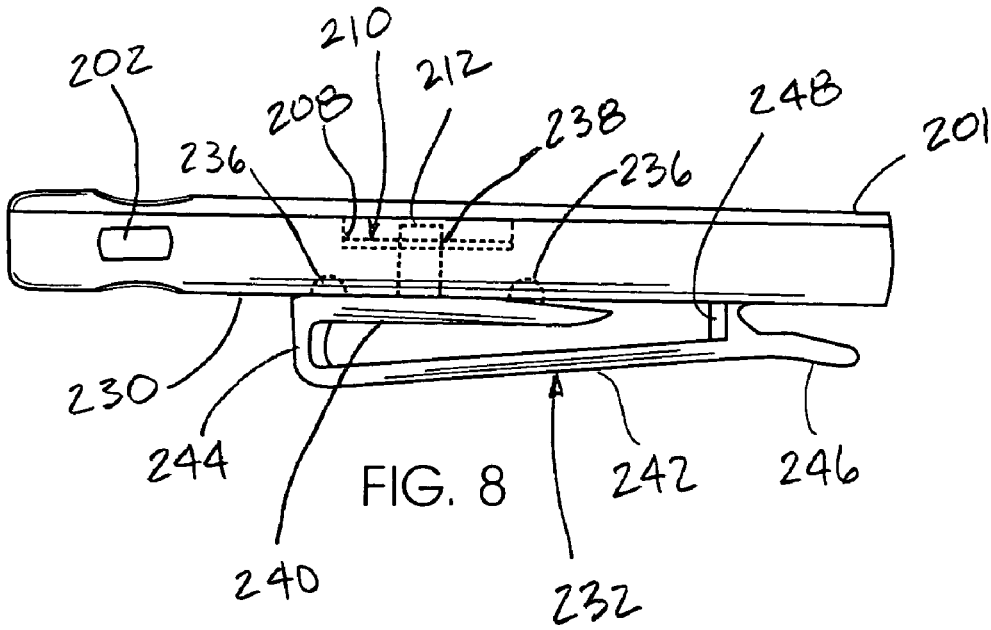
FIG. 8 is an illustration of a side view of the embodiment of FIG. 5.

FIG. 5 is a semi-schematic perspective view of an exemplary embodiment of a carrier 200 provided in accordance with aspects of the present invention. In one exemplary embodiment, the carrier 200 includes a carrier body 201 and an attachment device 232 (FIGS. 7 and 8). The carrier body 201 can include a carrier top 204, a carrier bottom 230, two spaced apart retaining channels 206, a receiving space 250 located therebetween, a retaining opening 202 located on each channel 206 for engaging the two locking protrusions 102 on the dispenser case 100, and a retainer recess 208 having an opening 238 for receiving the attachment device 232.

Figure 6:
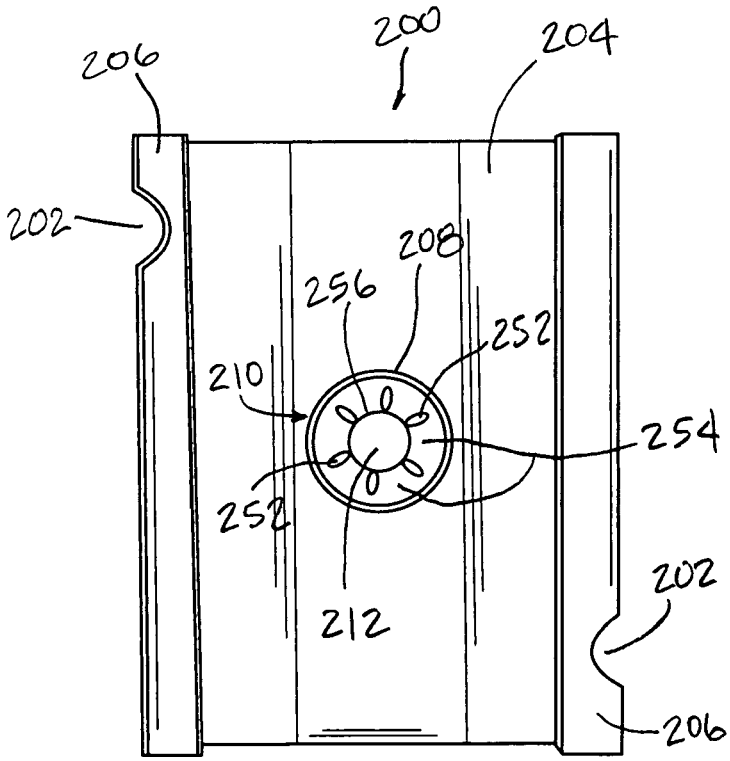
FIG. 6 is an illustration of a front view of the embodiment of FIG. 5.

The attachment device 232, which may be a self-biased clip or a spring-loaded arm, can include a shaft or pivot pin 212 that extends approximately orthogonally to the attachment device bottom 230 (FIG. 8). The shaft 212 is configured to be inserted through the hole 238 in the recess 208 of the carrier body 201 and retained thereto by a retaining washer 210. As shown in FIGS. 5 and 6, the retaining washer 210 comprises a round metallic plate or sheet comprising a plurality of serrations 252 defining a plurality of teeth 254. The retaining washer 210 includes an opening 256 sized slightly smaller than the diameter of the shaft 212 of the attachment device 232. Thus, when the opening 256 of the retaining washer 210 is placed over the shaft 212, the relative dimensions of the two causes the teeth 254 to deflect. As the retaining washer 210 is forced further onto the shaft 212, the teeth 254 engage the perimeter of the shaft 212 to retain the shaft to the carrier body 201.

The attachment device 232 provided in accordance with aspects of the present invention may be made from a similar material as the carrier body 201, with thermoplastic being more preferred. With reference to FIGS. 7 and 8, in one exemplary embodiment, the attachment device 232 comprises a short arm 240 connected to a long arm 242 by a connecting arm 244. The shaft 212 is connected to the short arm 240 and thus the short arm is connected to the carrier body 201 via the shaft. The long arm 242 comprises a flared end 246, which flares outwardly away from the carrier bottom 230 so as to provide clearance or space for receiving an article, such as a belt or a shirt pocket for attaching the dispenser case 100 and carrier 200 to a user. The long arm 242 further includes a projection 248, which is positioned generally orthogonally to the carrier bottom 230. The long arm 242 is manufactured or molded with a natural bias towards the direction of the carrier bottom 230. Thus, when an article is received between the carrier bottom 230 and the long arm 242, the long arm naturally clamps the article and the projection 248 grips the article to retain the article therein.

In one exemplary embodiment, the attachment device 232 is rotatable about the shaft 212. In other aspects of the present invention, two half-spherical bumps 236 are incorporated on the short arm 240. The two half-spherical bumps 236 may be molded onto and located on the elongated section of the short arm 240 (FIG. 8, shown as dot-dashed lines) adjacent the carrier bottom 230 and are spaced apart from one another. The bumps 236 are adapted to mate with corresponding divots or cavities 234 (FIG. 7) located on the carrier bottom 230. The engagement between the bumps 236 and the divots 234 fixes the attachment device 232 from rotating about the shaft 212. In one exemplary embodiment, two sets of two divots 234 (i.e., four divots) are incorporated on the carrier bottom 230 (FIG. 7) and are aligned so that the attachment device 232 may be rotated, engaged, and aligned along the lengthwise direction of the carrier body 201 or the widthwise direction of the carrier body. In an alternative embodiment, two or more divots may be incorporated and aligned such that the bumps 236 on the attachment device 232 may engage the divots 234 and align at an angle to either the lengthwise or widthwise axis of the carrier body 201. Still alternatively, only a combination of one bump and one divot is incorporated to fix the attachment device from freely rotating about the shaft. Still alternatively, only a friction contact between the attachment clip 210 and the recess 208 on the carrier body 201 is needed to prevent the attachment device 232 from freely rotating about the shaft 212.

Figure 9:
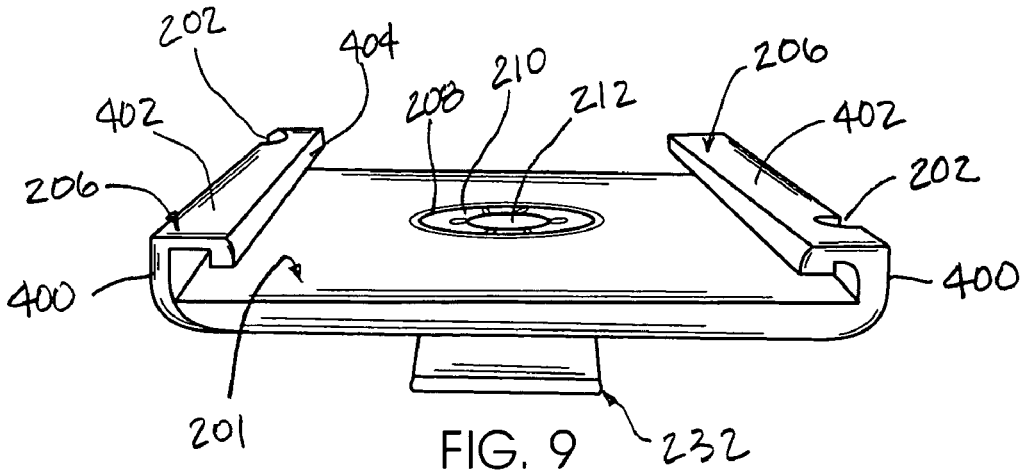
FIG. 9 is a perspective view of the embodiment of FIG. 5 from a different viewing angle.

Referring now to FIG. 9 in combination with FIGS. 5 and 6, the two retaining channels 206 each comprises a connecting wall 400, which connects to the carrier body 201, an overhanging wall 402, and a lip 404. The retaining opening 202 is incorporated into the overhanging wall 402 and part of the connecting wall 400 of each channel 206 at opposite ends of the two channels. The retaining openings 202 are preferably spaced apart from one another, are sized sufficiently, and are located appropriately to receive the two locking protrusions 102 located on the dispenser case 100. As is readily apparent to a person of ordinary skill in the art, the retaining openings 202 and the locking protrusions 102 may be repositioned elsewhere along the channels 206 and the flange 82, respectively.

Figure 10:
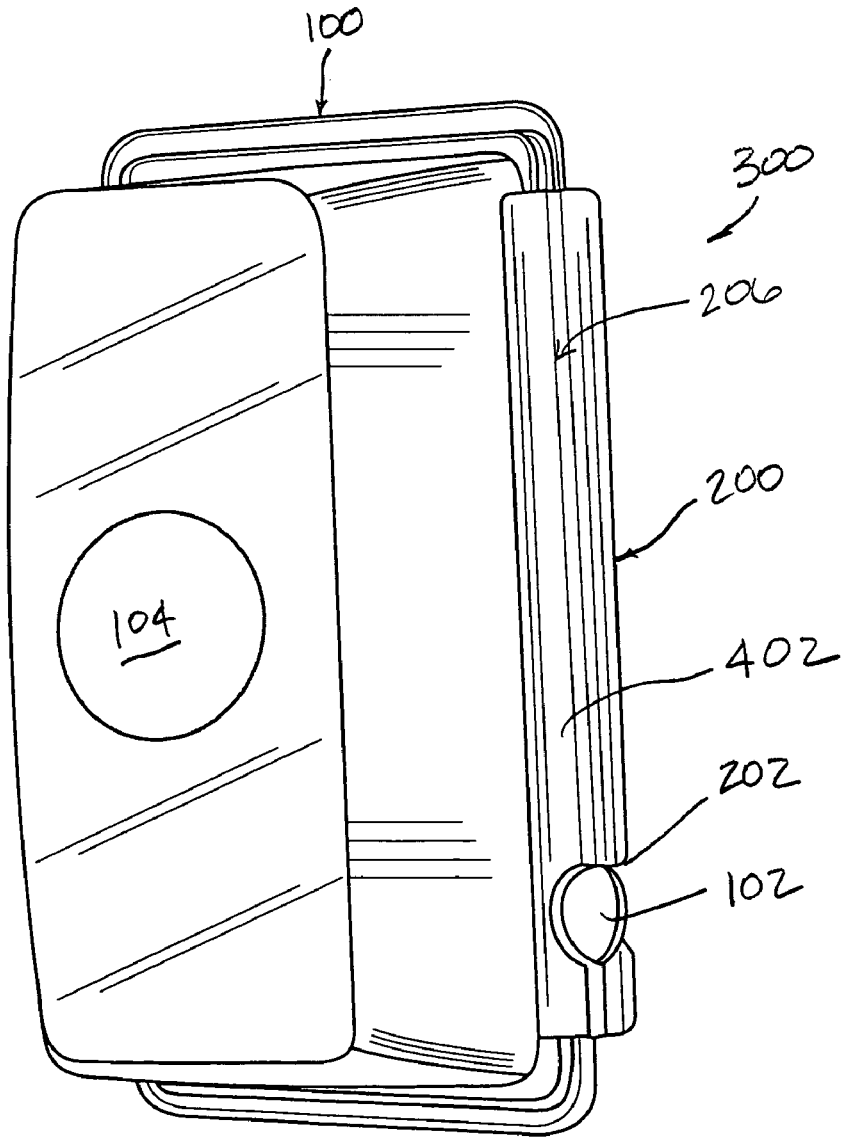
FIG. 10 is an exemplary semi-schematic perspective view of a glove assembly comprising a dispenser case engaged to a carrier provided in accordance with aspects of the present invention.

FIG. 10 shows a perspective view of a glove assembly 300 according to aspects of the present invention. The glove assembly 300 can include a dispenser case 100 and a carrier 200. In operation, the dispenser case 100 can slide into the receiving space 250 (FIG. 5) on the carrier 200 by sliding the flange 82 under the overhanging walls 402 of the two channels 206. The case 100 can slide in a direction parallel to the lengthwise axis until the locking protrusions 102 extend into the retaining openings 202. As is readily apparent to a person of ordinary skill in the art, the dispenser case 100 may be inserted into the receiving space 250 from either short wall end 110*a/b*. If enough lateral force is applied after the locking protrusions 102 engage the retaining openings 202, the locking protrusions can disengage from the retaining openings thus allowing the dispenser case 100 to be removed from the carrier, such as when it is emptied. A different dispenser case 100 containing a plurality of stacked gloves may be mounted to the carrier in the same manner as described above. In other words, the carrier 200 may be reusable while the dispenser case 100 may be disposable when emptied. Obviously, a reusable dispenser case 100 may be used with the carrier 200 by incorporating means for opening the case so that additional gloves may be refilled when the case is empty.

Figure 11:
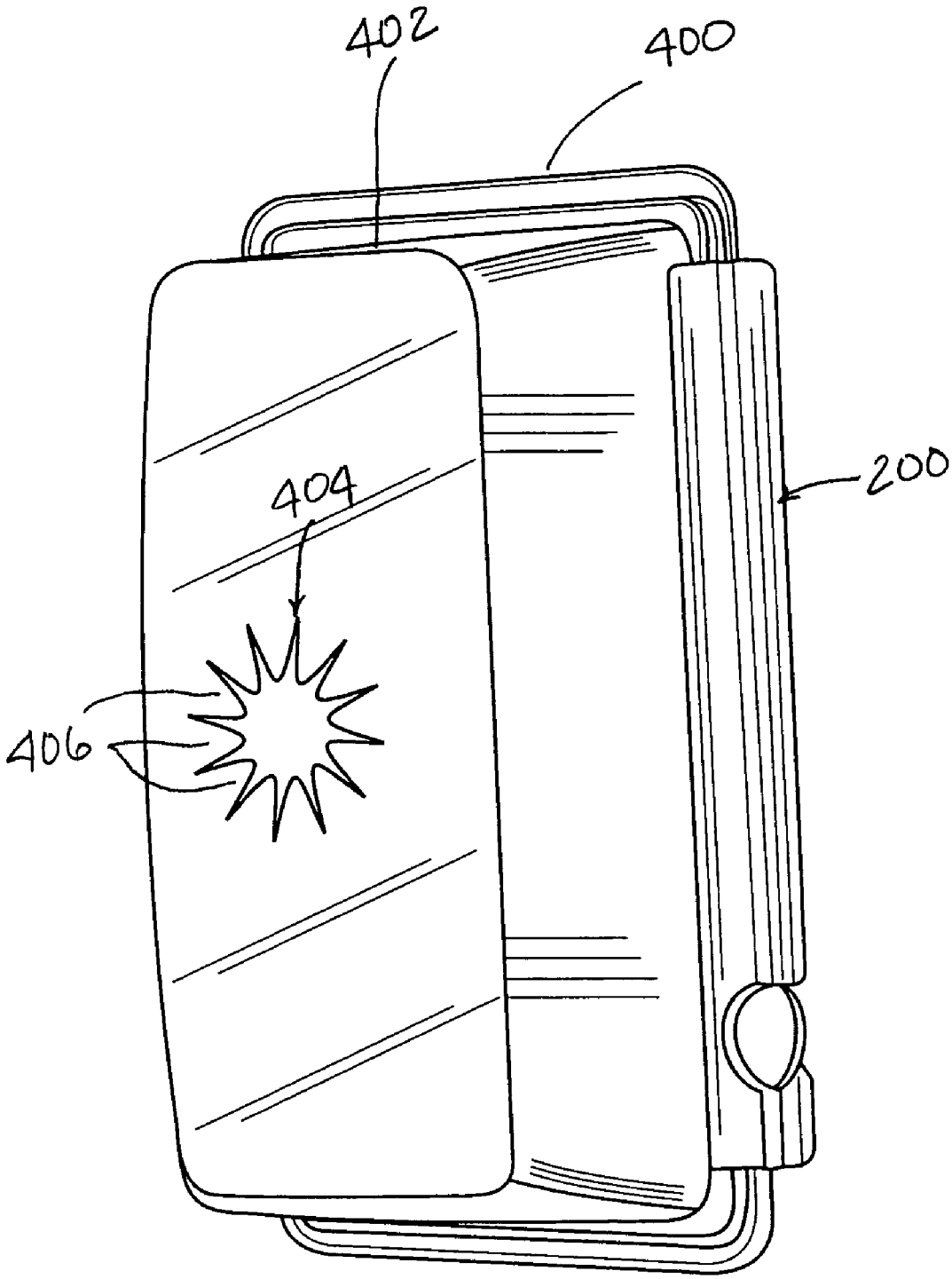
FIG. 11 is an exemplary semi-schematic perspective view of a glove assembly provided in accordance with other aspects of the present invention.

FIG. 11 shows a perspective view of an alternative embodiment of a glove assembly 400 provided in accordance with aspects of the present invention. The glove assembly 400 can include a dispenser case 402 and a carrier 200. The case 402 can have a dispenser opening 404 comprising a plurality of tabs 406. The tabs 406 reduces the effective opening of the case yet flexible enough to bend when a glove is retrieved to provide the necessary clearance for removing the glove. Alternatively, a square opening, an oval opening, a star shape opening, or any other shaped opening may be used in combination with a plurality of tabs 406.

Many alterations and modifications may be made by those having ordinary skill in the art, without departing from the spirit and scope of the invention. Therefore, it must be understood that the illustrated embodiments have been set forth only for the purposes of examples, and that the embodiments should not be taken as limiting the invention as defined by the following claims. The following claims are, therefore, to be read to include not only the combination of elements which are literally set forth, but all equivalent elements for performing substantially the same function in substantially the same way to obtain substantially the same result. The claims are thus to be understood to include those that have been illustrated and described above, those that are conceptually equivalent, and those that incorporate the ideas of the invention.

What is claimed is:

1. A dispenser case adapted to store a bundle of gloves and engage a carrier for use as a glove assembly, the dispenser case comprising a dispenser body comprising a plurality of side walls comprising a flange and a top wall comprising an opening, a base wall comprising a flange attached to the flange on the dispenser container along a common peripheral edge and defining a continuous perimeter, a locking protrusion extending radially away and coplanar with the attached two flanges, wherein the locking protrusion extends radially and forms part of the continuous perimeter, and wherein the plurality of side walls extend away from a plane defined by the attached two flanges.

2. The dispenser case of claim 1, wherein the plurality of side walls and top wall of the dispenser container are integrally formed.

3. The dispenser case of claim 1, wherein the dispenser case engages a channel on a carrier.

4. The dispenser case of claim 1, wherein the bundle gloves comprises a plurality of gloves each folded lengthwise to reduce its length and widthwise to reduce its width.

5. The dispenser case of claim 1, wherein the opening comprises a round configuration.

6. The dispenser case of claim 1, wherein the two flanges are welded together.

7. A dispenser case adapted to store a bundle of gloves and engage a carrier for use as a glove assembly, the dispenser case comprising a thermoplastic dispenser container comprising a plurality of side walls and a top wall comprising a dispensing opening and a base wall having four edges attached to the dispenser container and having a locking protrusion formed on at least two of the edges; a groove comprising two groove walls and a groove bottom defining a race extending along at least a portion of the base wall, wherein a plurality of gloves are disposed between the plurality of side walls, wherein the dispenser container comprises a flange and the base wall comprises a flange and wherein the two flanges are in contact with one another.

8. The dispenser case of claim 7, wherein the plurality of side walls and top wall of the dispenser container are integrally formed.

9. The dispenser case of claim 7, wherein the dispenser case engages a channel on a carrier.

10. The dispenser case of claim 7, wherein a bundle gloves comprises a plurality of gloves disposed inside the dispenser case and wherein each glove is folded lengthwise to reduce its length and widthwise to reduce its width.

11. The dispenser case of claim 7, wherein the opening comprises a round configuration.

* * * * *